US007052084B2

(12) United States Patent
Gillespie

(10) Patent No.: US 7,052,084 B2
(45) Date of Patent: May 30, 2006

(54) PORTABLE SHAMPOO BOWL AND CHAIR

(75) Inventor: Elnora Sheri Gillespie, 538 Heather La., Terrell, TX (US) 75160

(73) Assignee: Elnora Sheri Gillespie, Naperville, IL (US)

( * ) Notice: Subject to any disclaimer, the term of this patent is extended or adjusted under 35 U.S.C. 154(b) by 373 days.

(21) Appl. No.: 10/640,425

(22) Filed: Aug. 13, 2003

(65) Prior Publication Data

US 2004/0075314 A1 Apr. 22, 2004

Related U.S. Application Data

(60) Provisional application No. 60/413,290, filed on Sep. 26, 2002.

(51) Int. Cl.

| | |
|---|---|
| ***A47C 13/00*** | (2006.01) |
| ***A47C 4/00*** | (2006.01) |
| ***A47C 7/62*** | (2006.01) |
| ***A47B 83/02*** | (2006.01) |

(52) U.S. Cl. ..... 297/217.1; 297/1; 297/2; 297/16.1; 297/16.2; 297/17; 297/34; 297/51; 297/53; 297/118; 297/125; 297/129; 297/163; 297/188.04; 297/188.07

(58) Field of Classification Search ..... 297/1, 297/2, 16.1, 16.2, 17, 34, 51, 53, 118, 125, 297/129, 163, 188.04, 188.07, 217.1, 463.2
See application file for complete search history.

(56) References Cited

U.S. PATENT DOCUMENTS 1,165,918 A * 12/1915 Truchan ..... 297/129
2,089,737 A * 8/1937 Eliason et al. ..... 297/163
2,263,863 A * 11/1941 Wolfe ..... 297/163
2,267,861 A * 12/1941 Haley ..... 297/163
2,278,014 A * 3/1942 Olivant ..... 297/163
2,330,476 A * 9/1943 Donchess ..... 297/163
2,951,531 A * 9/1960 Dantes ..... 297/188.07 X
2,973,028 A * 2/1961 Celeste ..... 297/163
3,131,968 A * 5/1964 Alt ..... 297/188.04 X
3,245,716 A * 4/1966 Danner ..... 297/163
3,879,085 A * 4/1975 Morel ..... 297/182
4,057,244 A * 11/1977 Gaspar ..... 297/156 X
4,240,662 A * 12/1980 Anderson ..... 297/17
4,248,476 A * 2/1981 Phelps ..... 297/118
4,506,927 A * 3/1985 Lombardo ..... 297/118
4,840,000 A * 6/1989 Grines ..... 297/344.1 X
4,948,197 A * 8/1990 Sansing ..... 297/188.14
5,007,118 A * 4/1991 Ebersole ..... 297/310 X (Continued)

OTHER PUBLICATIONS

Applicant is not aware of any prior art relative to the application submitted herewith.

*Primary Examiner*—Rodney B. White
(74) *Attorney, Agent, or Firm*—John F. Bryan

(57) ABSTRACT

Apparatus for dispensing shampoos in cooperation with a counter-top sink has a chair seat, with legs hingedly attached for movement between a first extended, seat supporting position and a second, folded position for portability; a seat back hingedly attached to the chair seat for movement between an erect position and a folded, portable position, a bowl assembly with a drain adapted for being located over the counter-top sink and at least two extensible support members attached to the bowl at the underside thereof, for movement between a first, bowl supporting position and a second, portable position.

5 Claims, 3 Drawing Sheets

U.S. PATENT DOCUMENTS 5,803,417 A * 9/1998 McNamara et al. .... 297/156 X
6,517,162 B1 * 2/2003 Cheng ..... 297/440.14
6,585,316 B1 * 7/2003 Kucera ..... 297/188.07 X
6,663,176 B1 * 12/2003 Tull ..... 297/53 X
6,842,919 B1 * 1/2005 Wilson et al. ..... 297/180.15 X
2002/0053821 A1 * 5/2002 Ishimura ..... 297/217.1
2002/0158502 A1 * 10/2002 Cheng ..... 297/440.14
2004/0070237 A1 * 4/2004 Wilson et al. ..... 297/180.15

* cited by examiner

PORTABLE SHAMPOO BOWL AND CHAIR

This is a nonprovisional application claiming the benefit of the filing date of provisional application No. 60/413,290, filed on Sep. 26, 2002.

TECHNICAL FIELD

The present invention relates to the field of hair care and more particularly, to shampoo bowls which may be integrated into a portable chair assembly.

BACKGROUND

Parents, cosmetologists, medical care givers and others are often called on to give shampoos at home or in other informal surroundings. Outside of a salon, shampooing another persons hair involves discomfort and inconvenience to both parties. Not only is it difficult for the recipient to lean backwards over a typical sink, but the provider must usually work from an awkward position.

A first object of the present inventions is to provide apparatus which will make it less difficult for the hair care operator by providing easier, more convenient access to the client. A second object is to reduce incidental water spillage. A third object is to improve comfort for the recipient by providing a more accessible alternative to leaning over a standard sink. Yet another object is to provide the apparatus of the present inventions in a form that is readily transported and set up at any location of choice.

SUMMARY OF THE INVENTION

The present inventions contemplate improved apparatus for providing shampoo and like services These inventions relate to or employ some steps and apparatus well known in the cosmetology arts and therefore, not the subject of detailed discussion herein.

The present inventions comprise apparatus for dispensing shampoos in cooperation with a counter-top sink. A chair seat, with legs hingedly attached for movement between a first extended and locked, seat supporting position and a second, folded position for portability is set-up adjacent a counter-top sink. The chair further includes a seat back hingedly attached to the chair seat for movement between an erect position and a folded, portable position. A bowl assembly is provided as a separate component, with at least two extensible members attached to its underside to support the bowl above a counter-top sink.

BRIEF DESCRIPTION OF THE DRAWINGS

The accompanying drawings are incorporated into the specification to assist in explaining the present inventions. The drawings illustrate preferred and alternative examples of how the inventions can be made and used and are not to be construed as limiting the inventions to only those examples illustrated and described. The various advantages and features of the present inventions will be apparent from a consideration of the drawings in which.

DETAILED DESCRIPTION OF THE DRAWINGS

Figure 1:
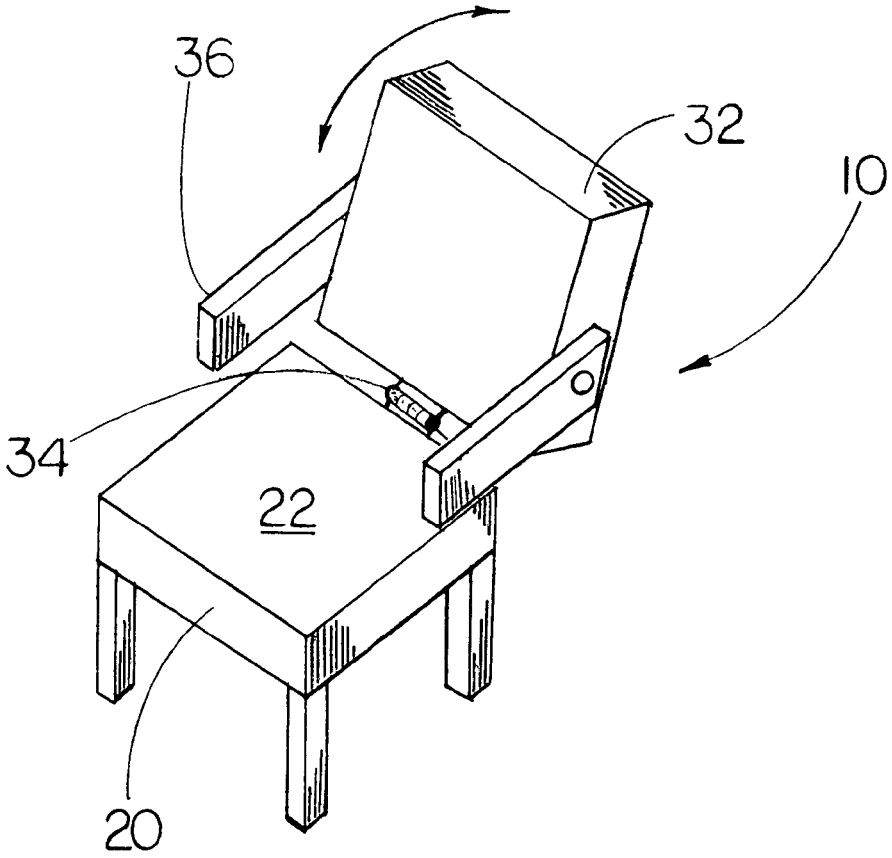
FIG. 1 is a perspective view of a preferred embodiment of the portable shampoo stand of the present inventions.

The present inventions are described in the following by referring to drawings of examples of how the inventions can be made and used. In these drawings, reference characters are used throughout the views to indicate like or corresponding parts. The embodiments shown and described herein are exemplary. Many details are well known in the art, and as such are neither shown nor described.

Figure 2:
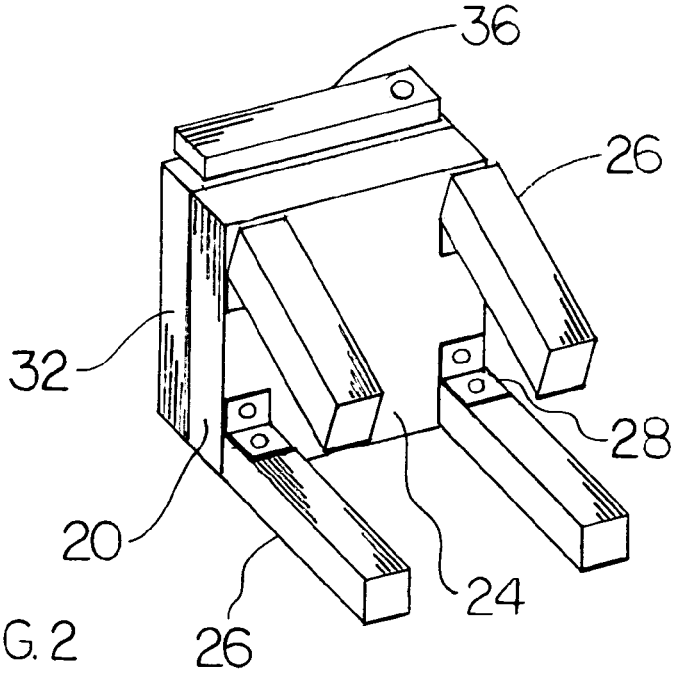
FIG. 2 is a perspective view of the shampoo bowl of FIG. 1.

FIGS. 1 and 2 show the portable shampoo chair assembly 10 of the present inventions. Chair seat 20 has a padded upper surface 22 and foldable legs 26 attached to the underside 24 by latching hinges 28. Hinges 28 are configured to allow legs 26 to fold flat against underside 24 and also to latch so as to hold legs 26 in an extended position for use. Chair back 32 is attached to chair seat 20 by hinges 34 that allow it to open up to the back supporting position of FIG. 1 and also, to fold flat against upper surface 22 for portability as shown in FIG. 2. In this embodiment, hinge 34 is a robust single unit, centrally located, so that the attachment to chair back can also provide a height adjustment capability. Arms 36 are pivotally attached at either side of chair back 32 for movement between the arm supporting position show in FIG. 1 and the folded position shown in FIG. 2.

Figure 3:
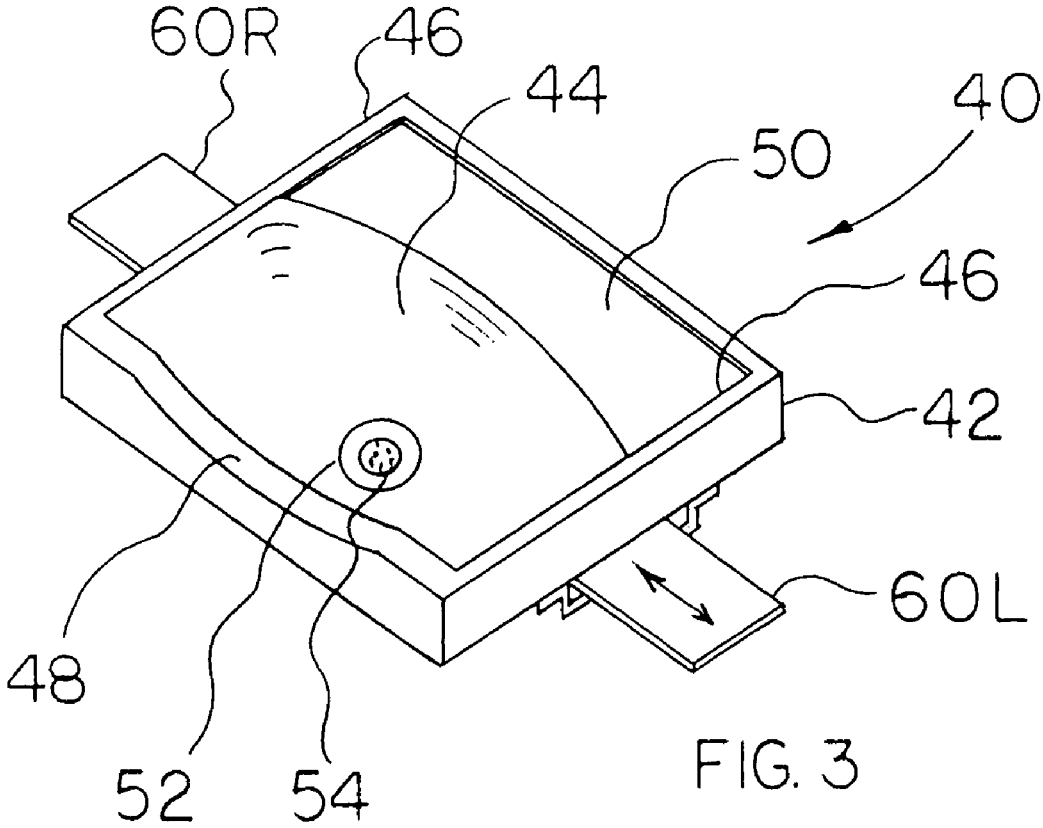
FIG. 3 is a perspective view of the folding chair of FIG. 1.
Figure 4:
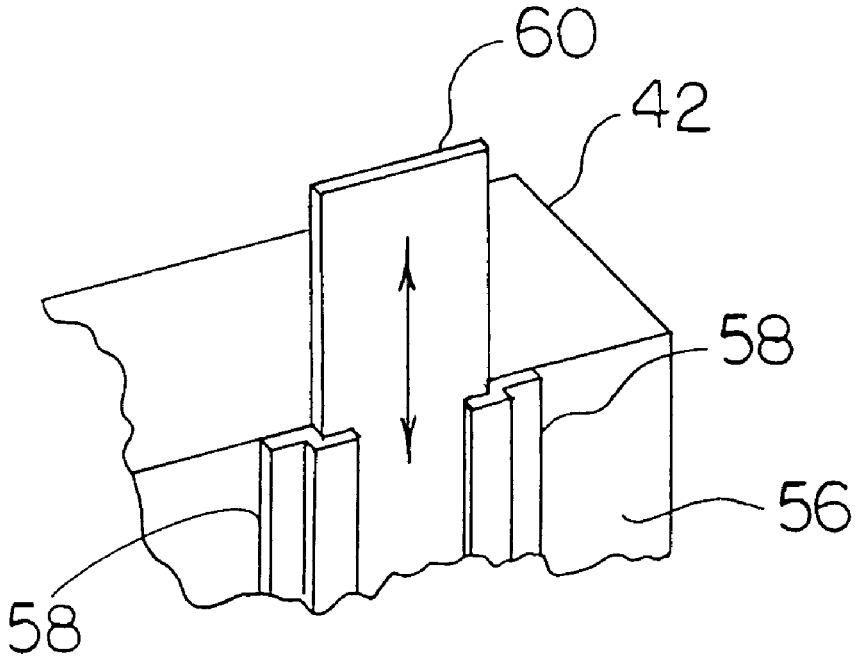
FIG. 4 is a view showing the underside of the shampoo bowl of FIG. 1.
Figure 5:
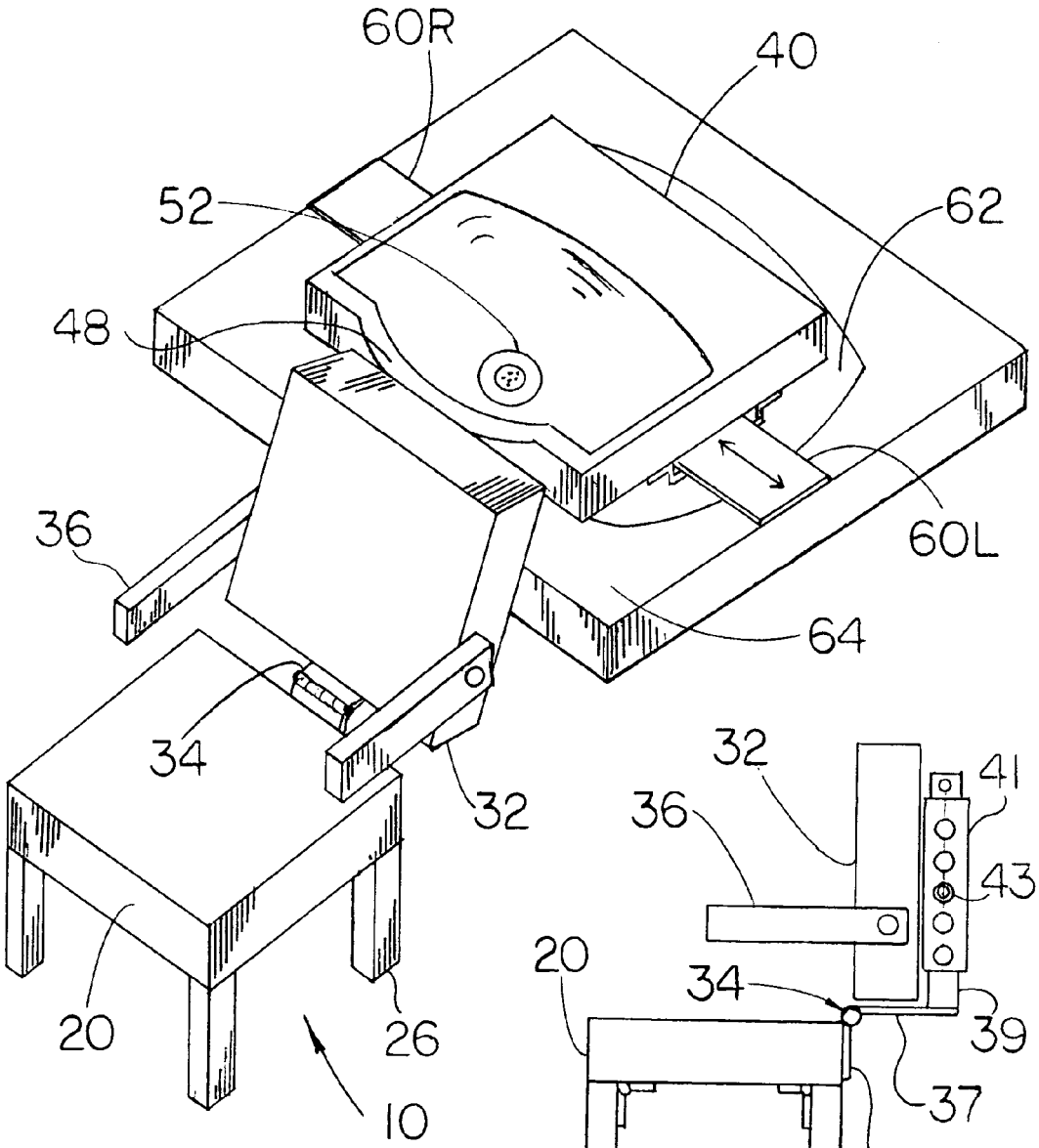
FIG. 5 is a perspective view showing the shampoo stand of the present inventions as it appears when ready for use.

FIGS. 3, 4 and 5 show the portable shampoo bowl assembly 40 of the present inventions. The molded unit 42 is preferably made of polypropylene or a similar plastic. Central bowl portion 44 is surrounded by reinforcing rim 46, which includes a depressed neck rest area 48 at the front and a wider ledge portion 50 at the rear as a shelf for utility purposes. Drain 52 is located at the lowermost point of bowl portion 44 and includes a perforated hair trap 54. Guide tracks 58 are attached to underside 56 of bowl unit 42 for sliding movement of right and left support arms 60R and 60L. When configured for portability, right and left support arms 60R and 60L are pushed inwardly so as to not extend significantly beyond reinforcing rim 46.

When configured for use, right and left support arms 60R and 60L are pulled out to so as to span the width of counter-top sink 62 as shown in FIG. 5. In this configuration, shampoo bowl assembly 40 of the present inventions is placed over sink 62, supported on counter top 64 by extended support arms 60R and 60L, so that the sink water supply and sink drain are available for use. Chair assembly 10 is opened up and unfolded at hinge 34 to place chair back 32 in an approximately vertical position, with arms 36 in an approximately horizontal position. The subject is thus, seated in front of counter top 64, with his or her head supported by neck rest 48 over bowl 44.

Figure 6:
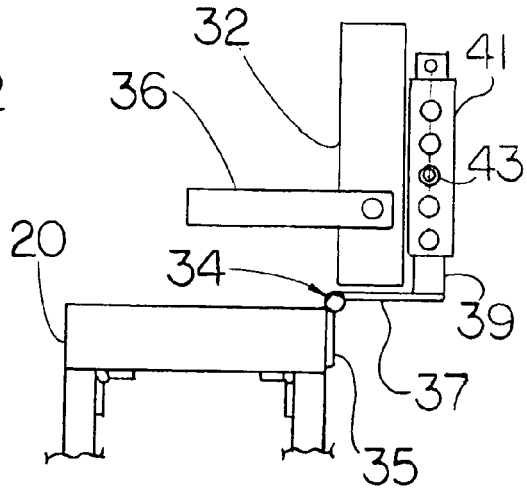
FIG. 6 shows a means for chair back height adjustment.

FIG. 6 shows the manner of adjustment of the height of chair back 32 with respect to chair seat 20. Hinge 34 includes attaching plates 35 and 37, wherein plate 35 is attached to the rear face of chair seat 20 and tubular back height adjustment member 39 extends vertically from plate 37. Hat section 41 fits around member 39 and is attached to the chair back 32. Hat section 41 and member 39 both include a set of spaced apart through holes for height adjustment by insertion of pin 43 through an appropriate set of holes.

The embodiments shown and described above are exemplary. It is not claimed that all of the details, parts, elements, or steps described and shown were invented herein. Even though many characteristics and advantages of the present inventions have been described in the drawings and accompanying text, the description is illustrative only. Changes may be made in the detail, especially in matters of shape, size, and arrangement of the parts within the scope and principles of the inventions. The restrictive description and drawings of the specific examples above do not point out what an infringement of this patent would be, but are to provide at least one explanation of how to use and make the inventions. The limits of the inventions and the bounds of the patent protection are measured by and defined in the following claims.

I claim:

1. Apparatus for dispensing shampoos in cooperation with a counter-top sink comprising:

a chair seat having upper and lower surfaces with legs hingedly attached at the lower surface for movement between a first extended, seat supporting position proximate the counter-top sink and a second, folded position for portability;

a seat back hingedly attached to the chair seat and movable between a first erect, back supporting position proximate the counter-top sink and a second position, folded on the chair seat for portability;

a bowl assembly having a drain aperture in the lowermost portion thereof, and adapted for being located proximate the seat back with the drain over the counter-top sink; and slidable horizontally extensible members attached to the bowl, the extensible members slidable between a first, outwardly extended position, greater than the width of the counter-top sink, for supporting the bowl thereover, and a second retracted position, for portability.

2. Apparatus for dispensing shampoos in cooperation with a counter-top sink according to claim 1 wherein the drain includes a hair trap.

3. Apparatus for dispensing shampoos in cooperation with a counter-top sink according to claim 1, and further comprising connecting members attaching the bowl to the seat back.

4. Apparatus for dispensing shampoos in cooperation with a counter-top sink according to claim 1, and further comprising folding arm members attached to the seat back for movement between a first, arm supporting position and a second position for portability.

5. Apparatus for dispensing shampoos in cooperation with a counter-top sink according to claim 1, wherein the bowl assembly includes a rim portion, depressed to accept the recipient's neck and extended rearwardly to provide a shelf for utility purposes.

* * * * *